US007316312B2

(12) United States Patent
Chiu

(10) Patent No.: US 7,316,312 B2
(45) Date of Patent: Jan. 8, 2008

(54) PROTECTIVE STRUCTURE OF DISC PACKAGING

(75) Inventor: Pei-Liang Chiu, Hsinchu Science Park (TW)

(73) Assignee: Princo Corp., Hsinchu Science Park (TW)

( * ) Notice: Subject to any disclaimer, the term of this patent is extended or adjusted under 35 U.S.C. 154(b) by 276 days.

(21) Appl. No.: 11/262,775

(22) Filed: Nov. 1, 2005

(65) Prior Publication Data

US 2007/0095685 A1 May 3, 2007

(51) Int. Cl.
*B65D 85/57* (2006.01)

(52) U.S. Cl. ..... 206/303; 206/308.1; 206/445; 206/497

(58) Field of Classification Search ..... 206/303, 206/497, 308.1, 499, 445, 591, 592, 593, 206/526, 309
See application file for complete search history.

(56) References Cited

U.S. PATENT DOCUMENTS 4,792,044 A * 12/1988 Nishizawa et al. ..... 206/394
2004/0099548 A1* 5/2004 Ito et al. ..... 206/303
2004/0182725 A1* 9/2004 Becker et al. ..... 206/310
2006/0096881 A1* 5/2006 Ozaki et al. ..... 206/445

* cited by examiner

*Primary Examiner*—David T. Fidel
(74) *Attorney, Agent, or Firm*—Rabin & Berdo, P.C.

(57) ABSTRACT

A "protective structure of disc packaging" of the invention comprises a protective body placed on the top and the bottom sides of a pile of discs; a heat-shrink film covers the protective body and said discs together for avoiding the discs from deforming the heat-shrink film. The characteristic of the invention lies in: the protective body is composed of at least two interlaced disc-shaped plates, which are made of corrugated paper or plastic corrugated sheet with wavy buffer portions. When the upper and the lower disc-shaped plates are disposed, the undulating buffer portions of the disc-shaped plates are vertically stacked up; in addition, the size of each disc-shaped plate is larger than the disc. The invention, therefore, is able to achieve the objectives of retaining the disc quality during the disc packaging and delivery processes, in addition, effectively reducing the disc packaging costs based on the requirement of environmental protection.

6 Claims, 6 Drawing Sheets

PROTECTIVE STRUCTURE OF DISC PACKAGING

BACKGROUND OF THE INVENTION

I. Field of the Invention

The present invention is related to a "protective structure of disc packaging", particularly, to a simply constructed disc protective structure, which is a protective body placed on the top and the bottom sides of a pile of discs, a heat-shrink film is used to cover both of the protective body and those discs contained, in order to avoid discs from being out of shape resulting from being directly covered by a heat-shrink film.

II. Description of the Prior Art

There are increasingly consumer electronic products on the market as disc storage media (such as CD, CD-R, CD-RW, DVD, DVD-R, DVD+R and DVD-RW, etc.); generally, a great quantity of blank discs are used by either a computer disc burner or a VCD/DVD+R/RW recorder and the packaging of those blank discs are enhanced by some proper protective structures during the packaging and delivery processes. Nevertheless, seeing that a mounting hub for holding a disc media is made 0.3 mm thicker than the burning area during manufacturing, there are gaps between each two discs when they are piled up together, so as to prevent those discs from the scratch damage by rubbing. Therefore, the disc packaging methods on the market at present are mostly piling up the discs, and then using a heat-shrink film to directly encase those discs, or using other proper packing containers. Generally, there are two frequently used packing containers described as follows:

1. A cylindrical container, as shown in FIG. 1, comprises a cap-like upper lid a and a base b; a shaft b1 is disposed extensively from the center of the base b upwards for piercing into a round hole c1 of a disc c in the center, thereby enabling a pile of discs c to be fixedly positioned in order; the base b sets a groove b2 on the perimeter thereof corresponding to a buckle a1 on the perimeter of the upper lid a. Upon using the container, the round holes c1 in the center of the pile of the discs c pierce through the shaft c1 of the base b in sequence, and then the container is covered with the upper lid a and the buckle a1 and the groove b2 are wedged together, thereby enabling the pile of the discs c to be under the most complete protection. Nevertheless, such a packaging is made by way of plastic injection shaping with specific molding, so as to increase the manufacturing costs, resulting in higher unit selling price; namely, such a packaging method incurs higher packaging costs to disc manufacturers.

2. A protective lid: as shown in FIG. 2 that the protective lid d is the same size as the diameter of the disc c, in addition, the protective lid d has one side thereof set a plurality of ring portions d1 in concentric circles, the plurality of ring portions d1 radially connect a plurality of supporting ribs d2 thereon; the circle center of the protective lid sets a round hole d3 corresponding to the round hole c1 of the disc c in the center. Upon the disc packaging, flat surfaces on one side of the protective lid d are respectively placed on the top and the bottom sides of the pile of discs c, and subsequently, a heat-shrink film encases both upper and lower sides of the protective lid d with the pile of the discs c together. Such a packaging is also made by way of plastic injection shaping with specific molding and an increase in the manufacturing costs, which may be a little bit lower than the cylindrical container manufacturing costs; nevertheless, such a packaging method enables the upper and the lower portions of the protective lid d that are made of harder material to directly press the force of deforming said heat-shrink film on several discs c near the protective lid d for forming a state without space in-between the pile of discs c, so as to cause damage of friction between the discs c during transport.

Therefore, the invention provides a disc protective structure that is placed on the top and the bottom sides of a pile of discs, and subsequently, a heat-shrink film is able to envelop the protective body and the pile of discs. The protective body is interlacedly made of resolvable corrugated paper and recyclable plastic corrugated sheet with simplified structure. Accordingly, the advantages of the invention include easily obtaining materials with cheaper prices and convenient manufacturing process, so that the invention is able to effectively reduce the disc packaging costs based on the requirement of environmental protection with the effect of completely protecting those manufactured discs.

SUMMARY OF THE INVENTION

The primary objective of the present invention is to provide a simplified protective structure for retaining the disc quality during the disc packaging and transporting processes, in addition, meeting the requirement of environmental protection and effectively reducing the disc packaging costs.

To achieve the aforementioned objective, the "protective structure of disc packaging" of the present invention primarily comprises a protective body that is disposed on the top and the bottom sides of a pile of discs. The protective body is composed of at least two interlaced disc-shaped plates, which are made of corrugated paper or plastic corrugated sheet, so as to form wavy buffer portions. When the upper and the lower disc-shaped plates are disposed, the undulating buffer portions of the disc-shaped plates are vertically stacked up, in addition, the size of each disc-shaped plate is larger than that of each disc; moreover, the circle center of each disc-shaped plate sets a round hole corresponding to the position of each disc.

Upon the disc packaging, the invention enables those discs to be piled up, seeing that a mounting hub for holding a disc media is made thicker than the burning area, there are gaps between each two discs when they are piled up together, the protective body is placed on the top and the bottom sides of those discs in a concentric circle, and then a heat-shrink film covers the protective body and those discs from the upper perimeter to the lower perimeter of the protective body for completing the disc packaging. The buffer portions of the protective body located on the top and the bottom sides of the discs are able to absorb the force resulting from the deformation of the heat-shrink film, so that those discs contained inside are not directly pressed by the force, resulting in the damage to those discs because of the space shrinking in-between the discs, so as to achieve the objective of retaining the disc quality during the disc packaging and delivery processes. Furthermore, said protective body of the invention is made of resolvable corrugated paper and recyclable plastic corrugated sheet with simplified structure. Accordingly, the advantages of the invention include easily obtaining materials with cheaper prices and convenient manufacturing process, so that the invention is able to effectively reduce the disc packaging costs based on the requirement of environmental protection with the effect of completely protecting those manufactured discs.

DESCRIPTION OF THE PREFERRED EMBODIMENT

To enable a further understanding of the structural features and contents of the invention, the brief description of the drawings below is followed by the detailed description of a preferred embodiment.

Figure 1:
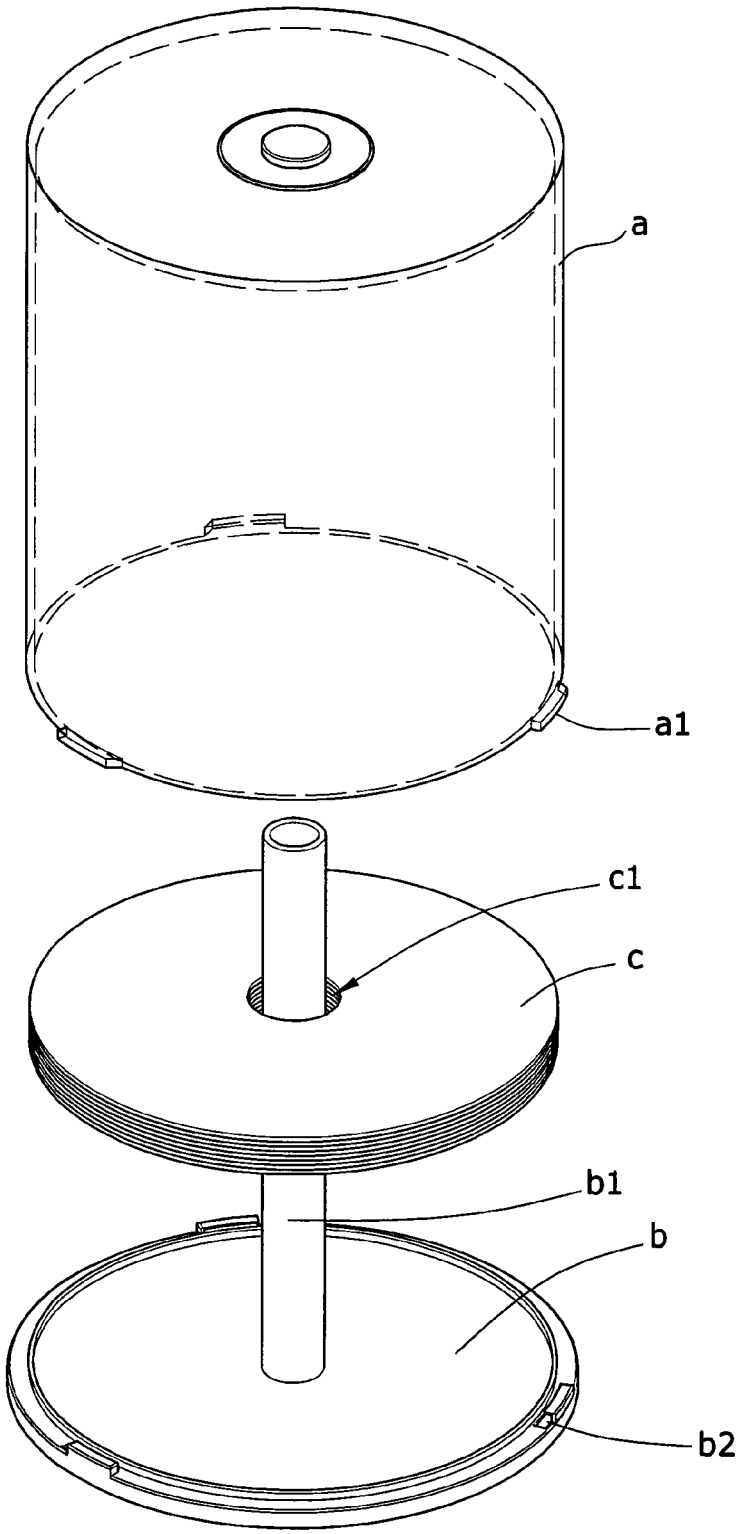
Fig.1(PRIOR ART)
FIG. 1 is a three-dimensional view of a conventional cylindrical container.
Figure 2:
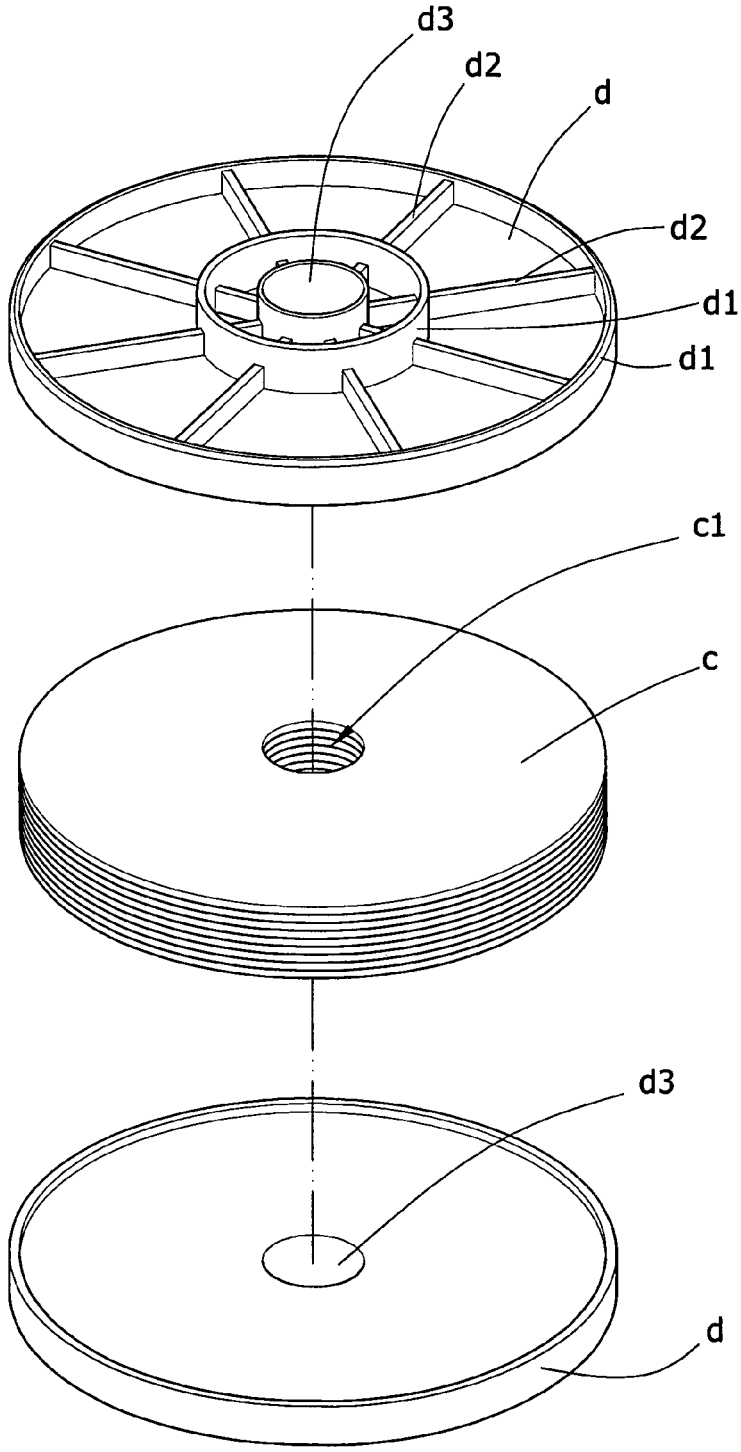
Fig.2(PRIOR ART)
FIG. 2 is a three-dimensional view of a conventional protective lid.
Figure 3:
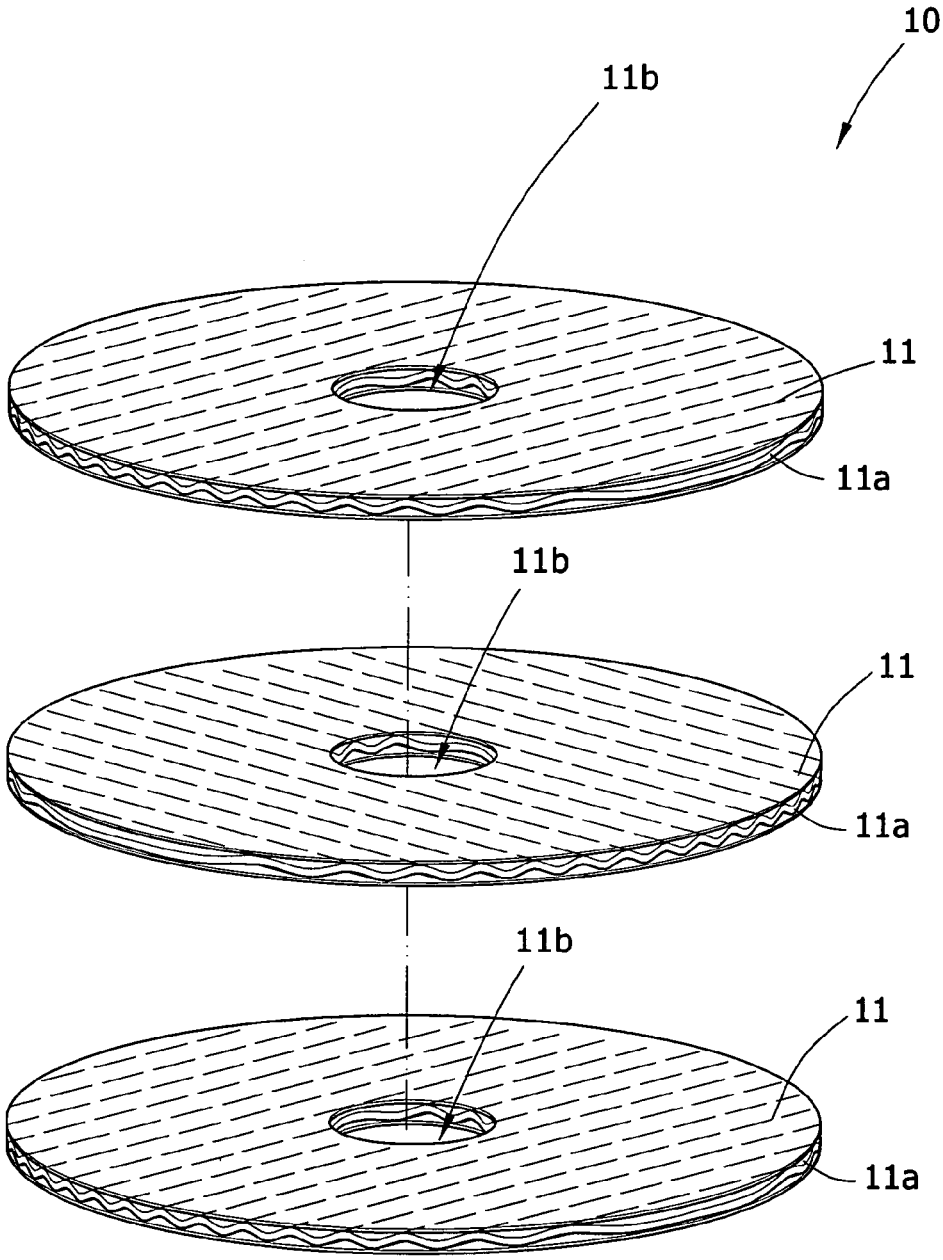
FIG. 3 is a three-dimensional view of the present invention.
Figure 4:
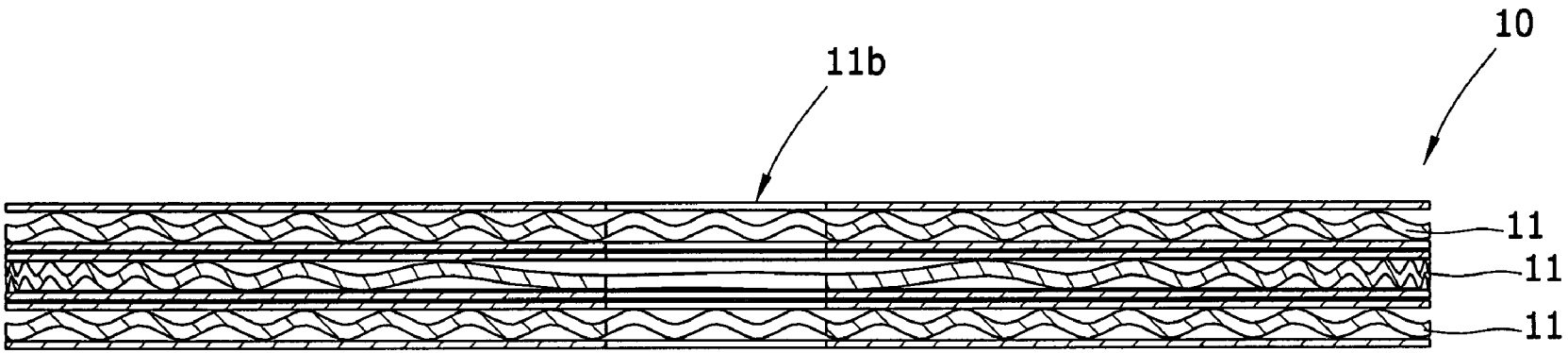
FIG. 4 is a cutaway view of the assembly of the present invention.
Figure 5:
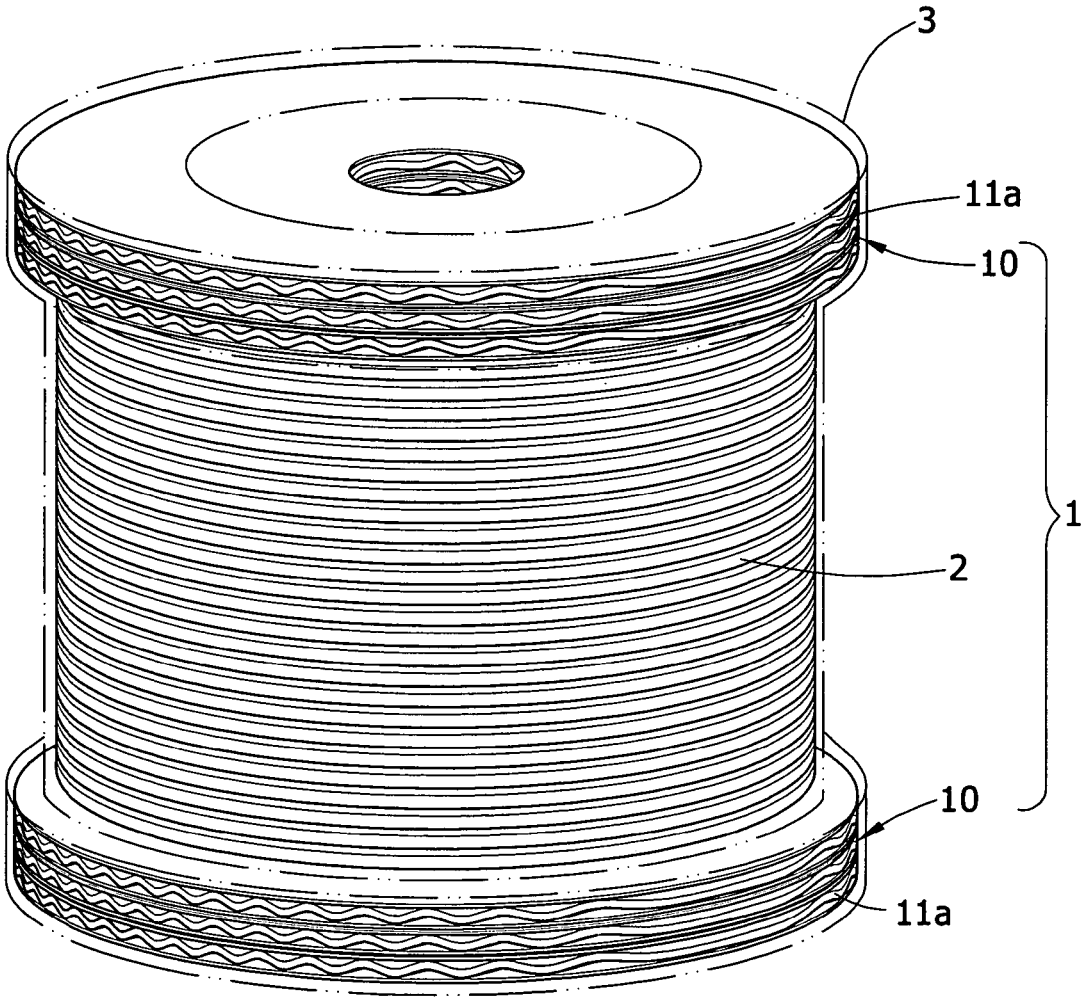
FIG. 5 is a three-dimensional view showing the present invention after packaging.
Figure 6:
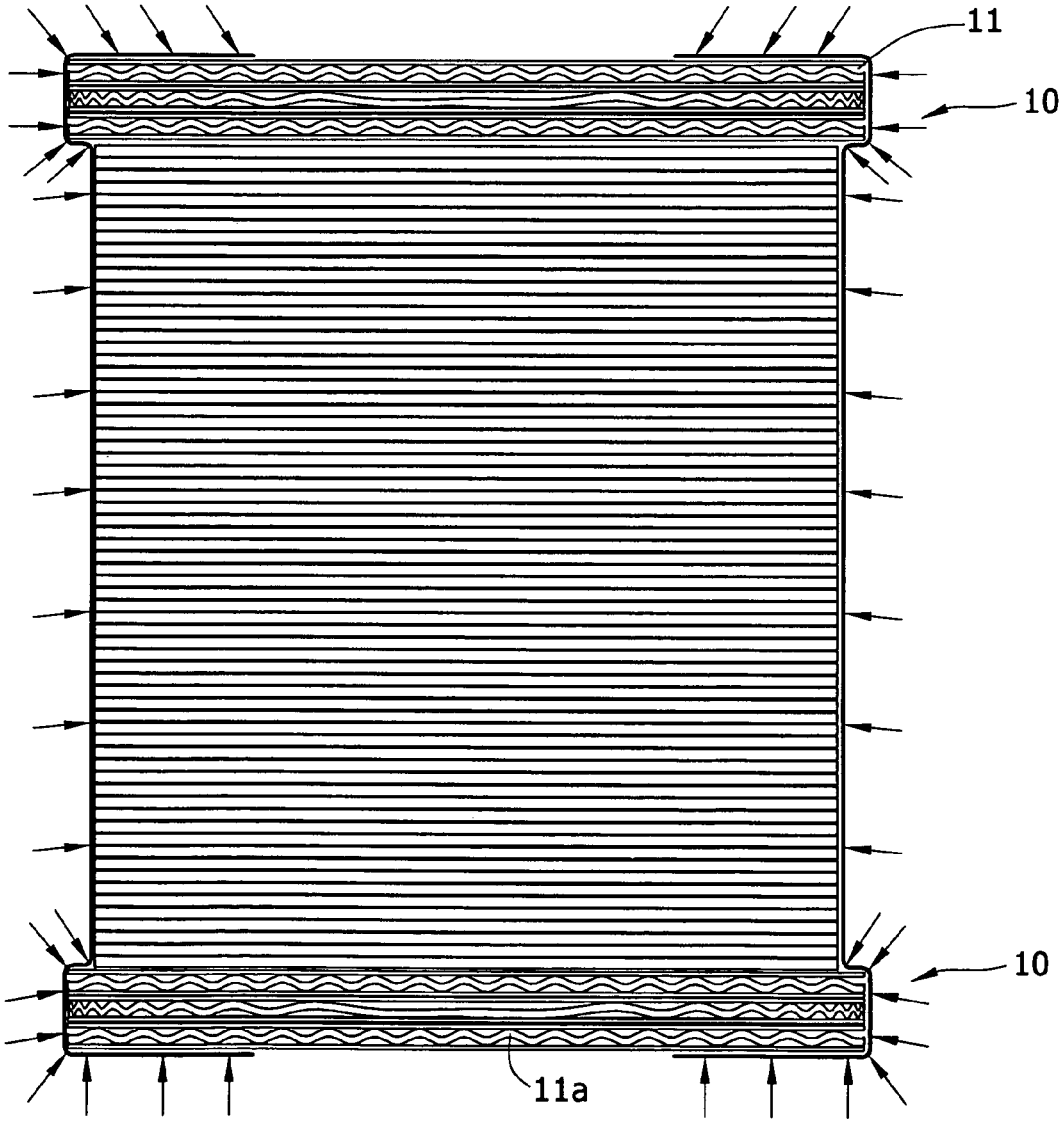
FIG. 6 is a perspective views showing the packaged invention under force.

With reference to FIGS. 3, 4 and 5, a protective structure of disc packaging in accordance with the present invention primarily comprises a protective structure 1, which is a protective body 10 placed on the top and the bottom sides of a pile of discs 2, wherein:

The protective body 10 is composed of at least two interlaced disc-shaped plates 11, the disc-shaped plates 11, which are made of corrugated paper or plastic corrugated sheet, so as to form wavy buffer portions 11*a*. When the upper and the lower disc-shaped plates 11 are disposed, the undulating buffer portions 11*a* of the disc-shaped plates are vertically stacked up, in addition, the sizes of the disc-shaped plates 11 are larger than those of the discs 2; moreover, the circle centers of said disc-shaped plates 11 set round holes 11*b* each corresponding to the position of the protective body 10 for piercing into a shaft that is used to place the discs 2. Moreover, the protective body 10 is made of a material that is easily absorbed by printing ink, thereby enabling the manufacturers to print out some advertising scripts and/or patterns relevant to said discs 2 on the surface of the protective body 10.

Upon the disc packaging, first of all, the invention enables the discs 2 to be piled up, and then the protective body 10 is disposed in a concentric circle on the top and the bottom sides of the discs 2, moreover, a heat-shrink film 3 covers the protective body 10 and the discs 2 together from the upper perimeter to the lower perimeter of the protective body 10, the packaging process then ends up. In addition, the wavy buffer portions 11*a* of the protective body 10 are able to absorb the force resulting from the deformation of the heat-shrink film 3, so that those discs 2 contained inside are not directly pressed by the force, resulting in the direct friction damage to those discs 2 because of the space shrinking in-between the discs 2.

In conclusion, said "protective structure of disc packaging" of the invention presented herein is a simply constructed protective body for retaining the disc quality during the disc packaging and delivery processes, in addition, effectively reducing the disc packaging costs based on the requirement of environmental protection.

Many changes and modifications in the above-described embodiment of the invention can, of course, be carried out without departing from the scope thereof. Accordingly, to promote the progress in science and the useful arts, the invention is disclosed and it's intended to be limited only by the scope of the appended claim.

What is claimed is:

1. A "protective structure of disc packaging" primarily comprising a protective body placed on the top and the bottom sides of a pile of discs; a heat-shrink film covers the protective body and said discs together for avoiding the discs from deforming the heat-shrink film; the characteristic lies in: the protective body is composed of at least two interlaced disc-shaped plates, possessing wavy buffer portions; when the upper and the lower disc-shaped plates are disposed, the undulating buffer portions of the disc-shaped plates are vertically stacked up, in addition, the size of the disc-shaped plates is larger than that of the discs.

2. The "protective structure of disc packaging" of claim 1, wherein the disc-shaped plates are made of corrugated paper.

3. The "protective structure of disc packaging" of claim 1, wherein the disc-shaped plates are made of plastic corrugated sheet.

4. The "protective structure of disc packaging" of claim 1, wherein the disc-shaped plates have the circle centers thereof set round holes corresponding to the positions of those discs.

5. The "protective structure of disc packaging" of claim 1, wherein the protective body enables the surface thereof to be printed some advertising scripts.

6. The "protective structure of disc packaging" of claim 1, wherein the protective body is able to be printed advertising patterns on the surface thereof.

* * * * *